US010697659B2

(12) United States Patent
Koizumi et al.

(10) Patent No.: US 10,697,659 B2
(45) Date of Patent: Jun. 30, 2020

(54) AIR-CONDITIONING CONTROL SYSTEM AND REMOTE CONTROL DEVICE

(71) Applicant: Mitsubishi Electric Corporation, Tokyo (JP)

(72) Inventors: Yoshiaki Koizumi, Tokyo (JP); Yoshihisa Kojima, Tokyo (JP); Mitsuru Kitazaki, Tokyo (JP); Hidetoshi Muramatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 6 days.

(21) Appl. No.: 16/060,503

(22) PCT Filed: Feb. 12, 2016

(86) PCT No.: PCT/JP2016/054098
§ 371 (c)(1),
(2) Date: Jun. 8, 2018

(87) PCT Pub. No.: WO2017/138141
PCT Pub. Date: Aug. 17, 2017

(65) Prior Publication Data

US 2018/0356115 A1 Dec. 13, 2018

(51) Int. Cl.
*F24F 11/56* (2018.01)
*F24F 11/89* (2018.01)
(Continued)

(52) U.S. Cl.
CPC ..... *F24F 11/56* (2018.01); *F24F 11/41* (2018.01); *F24F 11/54* (2018.01); *F24F 11/62* (2018.01);
(Continued)

(58) Field of Classification Search
CPC .. F24F 11/56; F24F 11/62; F24F 11/41; F24F 11/89; F24F 11/54; F24F 2140/12; F24F 2110/10
(Continued)

(56) References Cited

U.S. PATENT DOCUMENTS 8,341,970 B2 * 1/2013 Ouchi ..... F25D 21/002 62/151
9,450,408 B2 * 9/2016 Lu ..... H02J 3/14
(Continued)

FOREIGN PATENT DOCUMENTS

CN 101769574 A 7/2010
CN 103854457 A 6/2014
(Continued)

OTHER PUBLICATIONS

International Search Report of the International Searching Authority dated May 17, 2016 for the corresponding international application No. PCT/JP2016/054098 (and English translation).
(Continued)

*Primary Examiner* — James J Lee
*Assistant Examiner* — Christopher W Carter
(74) *Attorney, Agent, or Firm* — Posz Law Group, PLC

(57) ABSTRACT

An air-conditioning control system includes a plurality of air-conditioning apparatuses each provided with an indoor unit and an outdoor unit; a master remote control device associated with one or more of the plurality of air-conditioning apparatuses and adapted to control operation of the associated air-conditioning apparatus or apparatuses; and one or more slave remote control devices connected with the master remote control device using a first communication system, associated with a remaining one or ones of the plurality of air-conditioning apparatuses, and adapted to control operation of the associated air-conditioning appara-
(Continued)

tus or apparatuses, in which the indoor units of the air-conditioning apparatuses are connected with an associated one or ones of the master remote control device and the slave remote control device or devices using a second communication system different from the first communication system, and the master remote control device controls the operation of the remaining air-conditioning apparatus or apparatuses via the slave remote control device or devices.

7 Claims, 5 Drawing Sheets

(51) Int. Cl.
*F24F 11/62* (2018.01)
*F24F 11/41* (2018.01)
*F24F 11/54* (2018.01)
*F24F 140/12* (2018.01)
*F24F 110/10* (2018.01)

(52) U.S. Cl.
CPC ..... *F24F 11/89* (2018.01); *F24F 2110/10* (2018.01); *F24F 2140/12* (2018.01)

(58) Field of Classification Search
USPC ..... 700/276
See application file for complete search history.

(56) References Cited

U.S. PATENT DOCUMENTS

2006/0287774 A1* 12/2006 Yoon ..... F24F 3/06 700/276
2010/0010679 A1* 1/2010 Kassel ..... G05D 23/1931 700/278
2010/0174414 A1 7/2010 Takagi et al.
2012/0253521 A1* 10/2012 Storm ..... G05D 23/1905 700/276
2014/0324231 A1 10/2014 Kawai

FOREIGN PATENT DOCUMENTS

| | | | |
|---|---|---|---|
| CN | 103931208 | A | 7/2014 |
| EP | 3 098 533 | A1 | 11/2016 |
| GB | 2 266 167 | A | 10/1993 |
| JP | 03-217750 | A | 9/1991 |
| JP | 05-288392 | A | 11/1993 |
| JP | 2001-208406 | A | 8/2001 |
| JP | 2002-228236 | A | 8/2002 |
| JP | 2005-300016 | A | 10/2005 |
| JP | 2013-104645 | A | 5/2013 |
| JP | 2013-137189 | A | 7/2013 |
| JP | 2013-160477 | A | 8/2013 |
| JP | 2013-221676 | A | 10/2013 |
| JP | 2015-141014 | A | 8/2015 |

OTHER PUBLICATIONS

Extended European Search Report dated Jan. 22, 2019 issued in corresponding EP patent application No. 16889843.5.
Office action dated Apr. 17, 2019 issued in corresponding AU patent application No. 2016392133.
Office Action dated Feb. 3, 2020 issued in corresponding CN patent application No. 201680081131A (and English translation).

* cited by examiner

AIR-CONDITIONING CONTROL SYSTEM AND REMOTE CONTROL DEVICE

CROSS REFERENCE TO RELATED APPLICATION

This application is a U.S. national stage application of PCT/JP2016/054098 filed on Feb. 12, 2016, the contents of which are incorporated herein by reference.

TECHNICAL FIELD

The present invention relates to an air-conditioning control system and remote control device that control an air-conditioning apparatus including an outdoor unit and an indoor unit.

BACKGROUND ART

In a conventional air-conditioning system, a controller and an air-conditioning apparatus including an indoor unit and an outdoor unit are interconnected via a common bus and thereby allowed to exchange various information with each other. The common bus interconnecting the air-conditioning apparatus and the controller is an example of a medium used to conduct communications, and various media can be applied to the communications, regardless of whether they are each wired or wireless.

Also, in some conventional air-conditioning systems, each of air-conditioning apparatuses forming the system is provided with a controller (see, for example, Patent Literature 1). Where controllers are connected in a system as in the air-conditioning system described in Patent Literature 1, for example, a master control unit of the controller having the highest capacity functions as an upper-level master control unit, and assigns control units to lower-level master control units. Also, to control the air-conditioning apparatuses in the respective controllers, virtual control units are produced by the master control units.

By virtue of the above, it is possible to easily and efficiently produce the virtual control units even if controllers are connected in an air-conditioning system.

To install an additional air-conditioning apparatus and controller in such an air-conditioning system, a mechanism for installing and connecting the additional air-conditioning apparatus and controller via a common bus connected with existing air-conditioning apparatuses and controllers has been proposed.

CITATION LIST

Patent Literature

Patent Literature 1: Japanese Unexamined Patent Application Publication No. 2015-141014

SUMMARY OF INVENTION

Technical Problem

However, in an air-conditioning system not having a mechanism for installing and connecting an additional air-conditioning apparatus via a common bus, it is impossible to additionally install an additional air-conditioning apparatus.

The present invention has been made in consideration of the problem of the conventional technique described above, and an object of the invention is to provide an air-conditioning control system and a remote control device that allow an additional air-conditioning apparatus to be installed easily even if the system does not have a mechanism for installing an additional air-conditioning apparatus on a common bus.

Solution to Problem

An embodiment of the present invention provides an air-conditioning control system comprising: a plurality of air-conditioning apparatuses including both indoor units and outdoor units, respectively; a master remote control device associated with at least one of the plurality of air-conditioning apparatuses, and configured to control operation of the associated at least one of the plurality of air-conditioning apparatuses; and one or more slave remote control devices connected with the master remote control device using a first communication system, associated with a remaining one or ones of the plurality of air-conditioning apparatuses, and configured to control operation of the associated remaining one or ones of the plurality of air-conditioning apparatus. Each of the indoor units of the plurality of air-conditioning apparatuses is connected with an associated one of the master remote control device and the one or more slave remote control devices using a second communication system different from the first communication system. The master remote control device controls the operation of the remaining one or ones of the air-conditioning apparatuses with the one or more slave remote control devices.

Advantageous Effects of Invention

As described above, in the present invention, the master remote control device and slave remote control devices are connected using the first communication system, and the slave remote control devices can be controlled by the master remote control device. By virtue of this configuration, an additional air-conditioning apparatus can be easily installed.

DESCRIPTION OF EMBODIMENTS

Embodiment 1

An air-conditioning control system according to Embodiment 1 of the present invention will be described below.

The air-conditioning control system controls operation of device air-conditioning apparatuses using remote controllers. Each of the air-conditioning apparatuses belongs to any one of groups, and operation of each group is controlled by an associated remote controller.

[Configuration of Air-Conditioning Control System]

Figure 1:
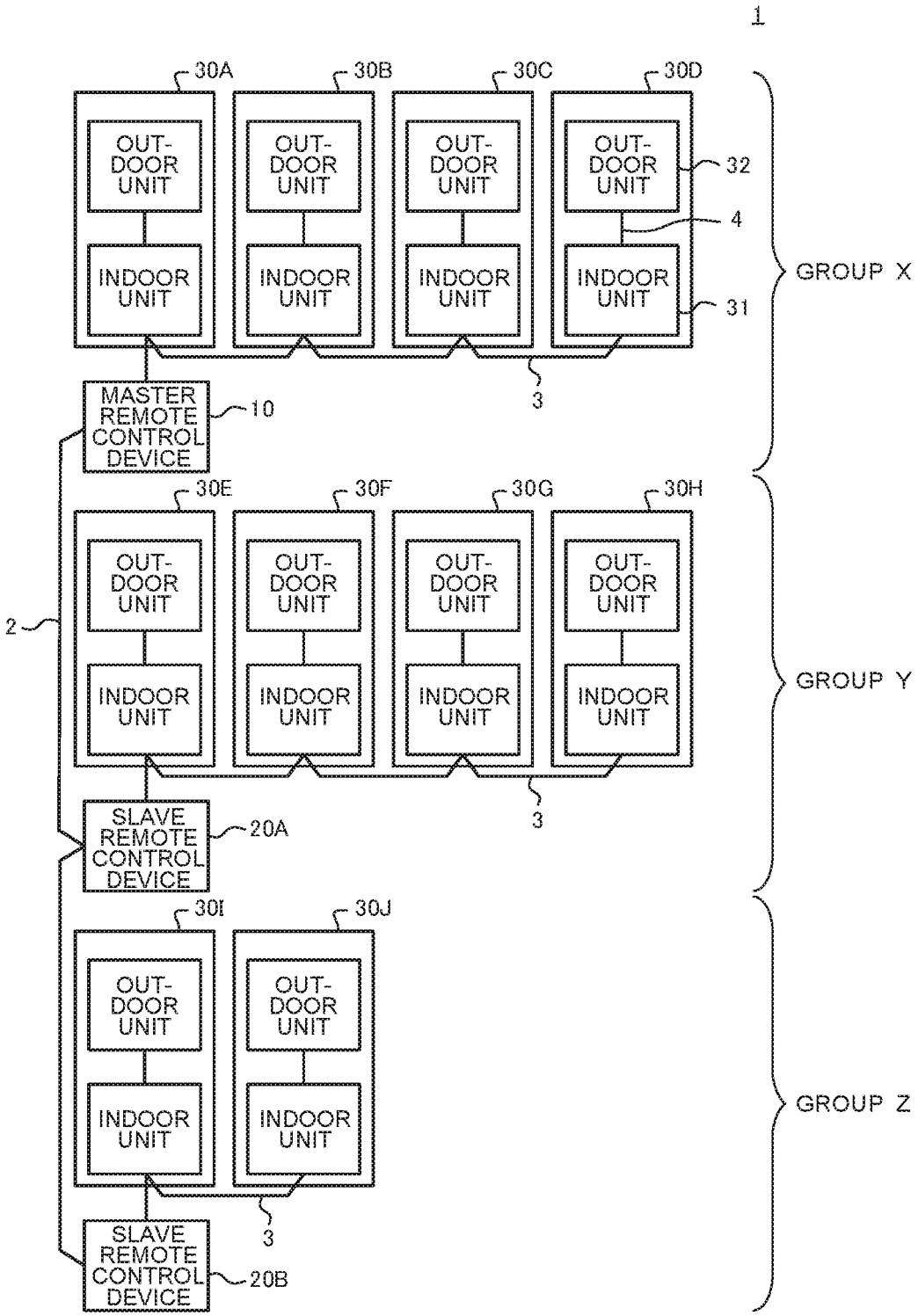
FIG. 1 is a block diagram showing an exemplary configuration of an air-conditioning control system according to Embodiment 1.
Figure 2:
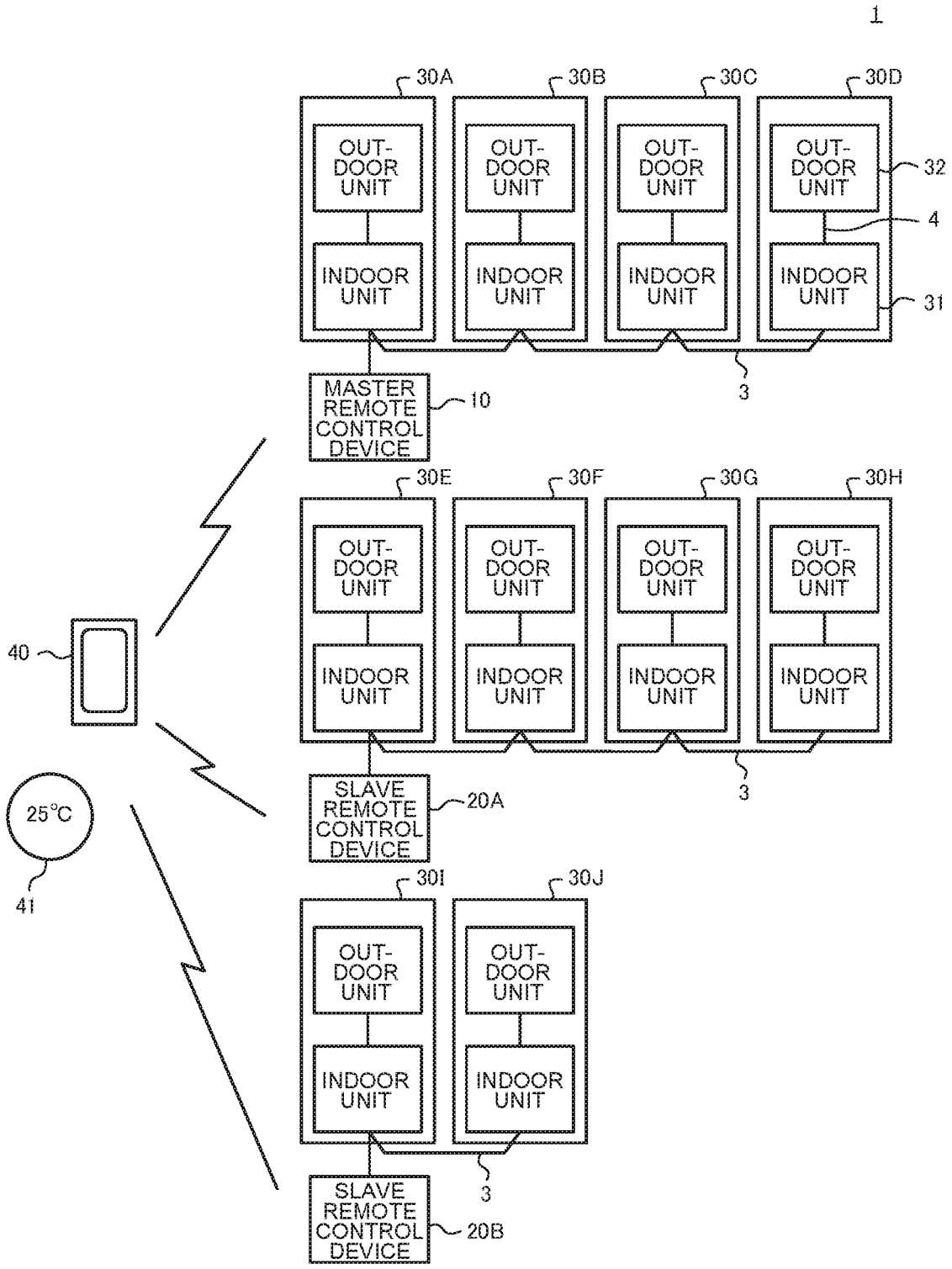
FIG. 2 is a block diagram showing another exemplary configuration of the air-conditioning control system according to Embodiment 1.

FIG. 1 is a block diagram showing an exemplary configuration of an air-conditioning control system 1 according to Embodiment 1. FIG. 2 is a block diagram showing another exemplary configuration of the air-conditioning control system 1 according to Embodiment 1.

It should be noted that in the drawings referred to in the following description, only connecting lines representing control relationships among components are indicated.

As shown in FIG. 1, the air-conditioning control system 1 is made up of one master remote controller device (hereinafter referred to as a "master remote control device") 10, one or more slave remote controller devices (hereinafter each referred to as "slave remote control device") 20, and air-conditioning apparatuses 30. In this example, the air-conditioning control system 1 is made up of one master remote control device 10, two slave remote control devices 20A and 20B, and ten air-conditioning apparatuses 30A to 30J.

In the air-conditioning control system 1, groups are provided, and each of the air-conditioning apparatuses 30 belongs to any one of the groups. Each group is associated with any of the master remote control device 10 and the slave remote control devices 20. Normally, operation of the air-conditioning apparatuses 30 belonging to each group is controlled by an associated one of the master remote control device 10 and the slave remote control devices 20.

In the example shown in FIG. 1, three groups, i.e., group X, group Y and group Z, are provided in the air-conditioning control system 1.

Four air-conditioning apparatuses 30A to 30D belong to group X, and are controlled by the master remote control device 10. Four air-conditioning apparatuses 30E to 30H belong to group Y, and are controlled by the slave remote control device 20A. Two air-conditioning apparatuses 301 and 30J belong to group Z, and are controlled by the slave remote control device 20B.

It should be noted that in the following description, in the case where the slave remote control devices 20A and 20B do not especially need to be distinguished from each other, each of them is simply referred to as "slave remote control device 20." Also, in the case where the air-conditioning apparatuses 30A to 30J do not especially need to be distinguished from each other, each of them is simply referred to as "air-conditioning apparatus 30" in the description.

(Master Remote Control Device)

The master remote control device 10 is used, for example, to control operation of the air-conditioning apparatuses 30, including operation mode setting, temperature setting, and air volume setting. The master remote control device 10 controls operation of the air-conditioning apparatuses 30 belonging to an associated one of the groups provided in the air-conditioning control system 1.

In this example, the master remote control device 10 is connected with the air-conditioning apparatuses 30A to 30D belonging to group X by connecting lines 3, and controls operation of the air-conditioning apparatuses 30A to 30D.

Also, the master remote control device 10 is connected with the slave remote control devices 20A and 20B described later, by connecting lines 2.

Via the connecting line 2, the master remote control device 10 receives, for example, information regarding the air-conditioning apparatus 30E to 30H connected to the slave remote control device 20A. Then, by controlling the connected slave remote control device 20A based on the received information, the master remote control device 10 can control operation of the air-conditioning apparatus 30E to 30H belonging to group Y to be controlled by the slave remote control device 20A.

Via the connecting lines 2, the master remote control device 10 receives, for example, information regarding the air-conditioning apparatuses 301 and 30J connected to the slave remote control device 20B. Then, by controlling the connected slave remote control device 20B based on the received information, the master remote control device 10 can control operation of the air-conditioning apparatuses 301 and 30J belonging to group Z to be controlled by the slave remote control device 20B.

(Slave Remote Control Devices)

Slave remote control devices 20 are used, for example, to control operation of air-conditioning apparatuses 30, including operation mode setting, temperature setting, and air volume setting. Each of the slave remote control devices 20 controls operation of the air-conditioning apparatuses 30 belonging to an associated one of the groups provided in the air-conditioning control system 1.

In this example, the slave remote control device 20A is connected with the air-conditioning apparatuses 30E to 30H belonging to group Y by connecting lines 3, and controls operation of the air-conditioning apparatus 30E to 30H. Also, the slave remote control device 20B is connected with the air-conditioning apparatuses 301 and 30J belonging to group Z by connecting lines 3, and controls operation of the air-conditioning apparatuses 301 and 30J.

The slave remote control device 20A transmits information regarding the air-conditioning apparatuses 30E to 30H belonging to group Y to the master remote control device 10 via a connecting line 2. Then, under control by the master remote control device 10 based on the transmitted information, the slave remote control device 20A controls the operation of the air-conditioning apparatuses 30E to 30H belonging to group Y.

The slave remote control device 20B transmits information regarding the air-conditioning apparatus 301 and 30J belonging to group Z to the master remote control device 10 via the connecting lines 2. Then, under control by the master remote control device 10 based on the transmitted information, the slave remote control device 20B controls the operation of the air-conditioning apparatus 301 and 30J belonging to group Z.

(Air-Conditioning Apparatus)

The air-conditioning apparatuses 30 each include an indoor unit 31 and outdoor unit 32.

The indoor unit 31 includes a use side heat exchanger not shown, and carries out heat exchange between indoor air and refrigerant, thereby performing cooling operation to cool the indoor air or performing heating operation to heat the indoor air.

The outdoor unit 32 includes a heat source side heat exchanger not shown, and carries out heat exchange between outdoor air and the refrigerant; to be more specific, during cooling operation, it causes heat from the refrigerant to be radiated to the outdoor air, thereby condensing the outdoor air, and during heating operation, it causes the refrigerant to be evaporated, thereby cooling the outdoor air with evaporation heat.

The indoor units 31 and outdoor units 32 are interconnected by connecting lines 4. Under control by the master remote control device 10 or slave remote control devices 20, the indoor units 31 control operation of the outdoor units 32 via the connecting lines 4.

It should be noted that in the example shown in FIG. 1, a connection relationship between the indoor units 31 and outdoor units 32 is established such that a single indoor unit 31 is connected to a single outdoor unit 32; however, the connection relationship of the Embodiment is not limited to that of the example. That is, it may be established such that a plurality of indoor units 31 are connected to a single outdoor unit 32.

[Connection Relationship Among Components]

Next, a connection relationship between the master remote control device 10, slave remote control devices 20A and 20B, and air-conditioning apparatuses 30 forming the air-conditioning control system 1 will be described.

The master remote control device 10 and the slave remote control devices 20A and 20B are connected with each other via the connecting lines 2, and communicate with each other using a first communication system to be described later. Specifically, the master remote control device 10 is connected to the slave remote control device 20A by a connecting line 2, and the slave remote control device 20A is connected to the slave remote control device 20B by a connecting line 2.

The master remote control device 10 and slave remote control devices 20 are connected with the air-conditioning apparatuses 30 belonging to the groups to be controlled by the remote control devices, respectively, and conduct communications using a second communication system different from the first communication system, where the air-conditioning apparatuses are connected with the respective remote control devices by the respective connecting lines 3 in an over wiring manner.

The master remote control device 10 is connected with the air-conditioning apparatus 30A to 30D belonging to group X by connecting lines 3. Specifically, the master remote control device 10 is connected to the air-conditioning apparatus 30A by a connecting line 3, and the air-conditioning apparatus 30A, 30B, 30C and 30D are connected to each other by connecting lines 3 in this order.

The slave remote control device 20A is connected with the air-conditioning apparatuses 30E to 30H belonging to group Y by connecting lines 3. Specifically, the slave remote control device 20A is connected to the air-conditioning apparatus 30E by a connecting line 3, and the air-conditioning apparatuses 30E, 30F, 30G and 30H are connected to each other by connecting lines 3 in this order.

The slave remote control device 20B is connected with the air-conditioning apparatuses 301 and 30J belonging to group Z by connecting lines 3. Specifically, the slave remote control device 20B is connected to the air-conditioning apparatus 301 by a connecting line 3, and the air-conditioning apparatus 301 is connected to the air-conditioning apparatus 30J by a connecting line 3.

In such a manner, by connecting the master remote control device 10 or slave remote control devices 20 with the air-conditioning apparatus 30 by over wiring, it is possible to easily connect, when an additional air-conditioning apparatus 30 is installed in a group, the additional air-conditioning apparatus 30 to an associated one of the remote control devices.

It should be noted that the master remote control device 10 and slave remote control devices 20A and 20B are supplied with electric power from the indoor units 31 of the air-conditioning apparatuses 30 connected to the respective remote control devices.

In each air-conditioning apparatus 30, the indoor unit 31 and outdoor unit 32 are interconnected by the connecting line 4, and communicate with each other using a third communication system to be described later.

[Systems of Communication Between Devices]

Next, systems of communication between the devices connected to the connecting lines 2 to 4 will be described.

Communications between the indoor unit 31 and outdoor unit 32 via the connecting lines 4 are conducted using the third communication system. As the third communication system, for example, a communication system described in Japanese Patent No. 2948502 or a general-purpose, multi-drop communication system such as RS-485, which is an EIA (Electronic Industries Association) communication standard, can be applied.

In the third communication system, for example, a connecting line 4 in which an AC power line and a communications line are made up of a single line is applied or a connecting line 4 in which an AC power line and a specific communications line different from the AC power line are made up of two lines is applied.

The former connecting line 4 is easier to form than the latter connecting line 4 but shorter in communication range and lower in communication speed. Therefore, the number of indoor units 31 connectable to one outdoor unit 32 is, for example, four at the maximum. The following description is given by referring to by way of example the case in which the former connecting line 4 is applied.

Communications between the master remote control device 10, slave remote control devices 20A and 20B, and air-conditioning apparatus 30 via the connecting lines 3 are conducted using the second communication system.

Since the number of indoor units 31 connectable to one outdoor unit 32 is limited by the third communication system, the number of indoor units 31 connectable to each of the master remote control device 10 and slave remote control devices 20A and 20B in the second communication system is limited to four as well. This is because where, for example, the communication system described in Japanese Patent No. 2948502 as referred to above is used as the third communication system, the amount of current supplied to each indoor unit 31 decreases as the number of indoor units 31 connected to one outdoor unit 32 increases, as a result of which bit determination of communication data is harder to perform.

Also, the following description is given on the assumption that the four indoor units 31 are controlled in the same manner in operation mode setting, temperature setting, air volume setting, etc.

Specifically, the indoor units 31 of the air-conditioning apparatuses 30 belonging to the same group are controlled by the master remote control device 10 or slave remote control device 20 to operate in the same manner.

Communications between the master remote control device 10 and slave remote control devices 20A and 20B via the connecting lines 2 are conducted using the first communication system.

The first communication system is, for example, is a wireless communication system such as BLE (Bluetooth [registered trademark] Low Energy), which is a short-distance wireless communication, and can wirelessly connect the master remote control device 10 with the slave remote control devices 20A and 20B. When such a short-distance wireless communication system is applied, it is possible to reduce the capacity for supplying power from the indoor units 31 to the master remote control device 10 and slave remote control devices 20A and 20B.

Also, where the wireless communication system is applied as the first communication system, as illustrated in, for example, FIG. 2, it can be connected with a general-purpose device. For example, it can be connected with a portable terminal 40 such as a tablet or a smartphone, or with a temperature and humidity sensor 41. Furthermore, if it is connected with the portable terminal 40, it is possible to remotely operate the master remote control device 10 by use of the portable terminal 40. Thus, a user does not need to move to the position of the master remote control device 10 to operate it.

In the air-conditioning control system 1 configured in the above manner, by conducting communications between the master remote control device 10 and slave remote control devices 20 using the first communication system, it is possible to substantially increase the number of air-conditioning apparatuses 30 controllable by the master remote control device 10.

Also, the slave remote control devices 20 function as relay devices adapted to relay communications with the master remote control device 10 using the first communication system and communications with the air-conditioning apparatus 30 using the second communication system.

Slave remote control devices 20 can be connected to the master remote control device 10, and the air-conditioning apparatuses 30 connected to the master remote control device 10 or slave remote control devices 20 are operated under control by the master remote control device 10.

[Configuration of Master Remote Control Device]

Next, a configuration of the master remote control device 10 will be described.

Figure 3:
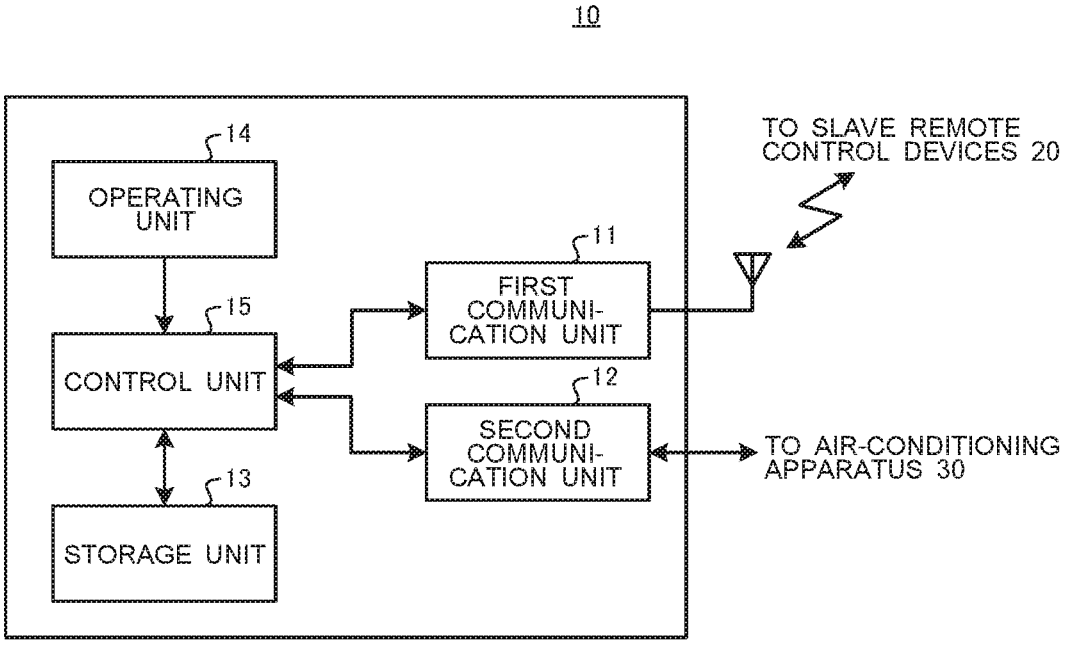
FIG. 3 is a block diagram showing an exemplary configuration of a master remote control device shown in FIG. 1.

FIG. 3 is a block diagram showing an exemplary configuration of the master remote control device 10 shown in FIG. 1.

As shown in FIG. 3, the master remote control device 10 includes a first communication unit 11, a second communication unit 12, a storage unit 13, an operating unit 14, and a control unit 15.

The first communication unit 11 communicates with the slave remote control devices 20 according to a predetermined communication protocol using a wireless communication system, which is the first communication system.

For example, the first communication unit 11 receives information regarding the indoor units 31 of the air-conditioning apparatuses 30E to 30J connected to the respective slave remote control devices 20 from the slave remote control devices 20 connected to the master remote control device 10. The first communication unit 11 supplies the received information regarding the indoor units 31 to the control unit 15.

Also, under control by the control unit 15 to be described later, the first communication unit 11 transmits setting information received from the control unit 15, which includes various settings such as operation mode setting, temperature setting, and air volume setting, to each of the slave remote control devices 20 connected to the master remote control device 10.

The second communication unit 12 communicates with the air-conditioning apparatuses 30A to 30D in group X to which the master remote control device 10 belongs, according to a predetermined communication protocol using the second communication system.

For example, under the control by the control unit 15, the second communication unit 12 transmits the setting information supplied from the control unit 15, to the air-conditioning apparatuses 30A to 30D in group X.

Also, the second communication unit 12 receives information regarding the indoor units 31 from the air-conditioning apparatuses 30A to 30D, and supplies the information to the control unit 15.

Under the control by the control unit 15, the storage unit 13 stores various information including the number of slave remote control devices 20 connected to the master remote control device 10 and the number of air-conditioning apparatuses 30 connected to the master remote control device 10 or slave remote control devices 20.

The operating unit 14 includes keys for use to make various settings such as the operation mode setting, temperature setting, and air volume setting of the air-conditioning apparatus 30, or an operating element to be operated by the user, such as a touch panel stacked on a display unit not shown. When operated by the user, the operating unit 14 produces a control signal corresponding to this operation, and outputs the control signal to the control unit 15.

The control unit 15 controls operation of each of components of the master remote control device 10. The control unit 15 is made up of software, etc., which is to be executed, for example, on an arithmetic unit such as a microcomputer or CPU (Central Processing Unit).

Based on the control signal supplied from the operating unit 14, the control unit 15 determines the air-conditioning apparatus 30 to be operated, and produces setting information for use to control operating states of the air-conditioning apparatuses 30 provided in the air-conditioning control system 1. Then, the control unit 15 supplies the setting information to the first communication unit 11 to transmit the setting information to the slave remote control device 20 associated with the air-conditioning apparatus 30 to be operated.

Also, based on the information regarding the indoor units 31 received via the first communication unit 11 and second communication unit 12, the control unit 15 produces information indicating the number of air-conditioning apparatuses 30 connected to the master remote control device 10 or slave remote control devices 20, and stores the produced information in the storage unit 13.

[Installation of Additional Air-Conditioning Apparatus in Air-Conditioning Control System]

In the case of installing an additional air-conditioning apparatus 30 in the air-conditioning control system 1 as shown in FIG. 1, the slave remote control device 20 associated with the additional air-conditioning apparatus 30 to be installed is connected to the master remote control device 10 by a connecting line 2. Consequently, the master remote control device 10 is connected with the slave remote control device 20 using the first communication system, and can control the operation of the additional air-conditioning apparatus 30 connected to the slave remote control device 20.

It should be noted that the number of slave remote control devices 20 connectable to the master remote control device 10 depends on the communication protocol of the first communication system. In this example, for example, 64 slave remote control devices 20 can be connected. On the other hand, the number of air-conditioning apparatus 30 connectable to one slave remote control device 20 is limited to four in this example, as described above.

Thus, the number of air-conditioning apparatuses 30 controllable by the master remote control device 10 is 256 at the maximum.

As described above, in Embodiment 1, the master remote control device 10 and slave remote control devices 20 are connected by the connecting lines 2 using the first communication system, allowing the master remote control device 10 to control the air-conditioning apparatuses 30 connected to the slave remote control devices 20. Therefore, even if the number of air-conditioning apparatuses 30 controllable by a single remote control device such as the master remote control device 10 is limited, the number of controllable air-conditioning apparatuses 30 can be substantially increased. That is, in the entire system, the number of air-conditioning apparatuses 30 controllable by a single remote control device can be increased.

In such a manner, an additional air-conditioning apparatus 30 can be installed by interconnecting the master remote control device 10 and the slave remote control devices 20. Therefore, even in an air-conditioning system not having a mechanism for connecting air-conditioning apparatuses with a common bud, an additional air-conditioning apparatus can be installed easily.

Also, in the above configuration, the master remote control device 10 can communicate with the slave remote control devices 20 using the first communication system. It is therefore possible to increase the number of air-conditioning apparatuses 30 controllable by a single remote control device, while maintaining a conventional system.

Embodiment 2

Next, an air-conditioning control system according to Embodiment 2 will be described.

Air-conditioning control system according to Embodiment 2 controls the operation of the air-conditioning apparatuses in the system such that the system will operate at a maximum COP (Coefficient Of Performance), which represents energy consumption efficiency of the entire system.

It should be noted that that in the following description, components similar to those of Embodiment 1 are denoted by the same reference numerals as the corresponding components of Embodiment 1, and their descriptions are thus omitted.

[Configuration of Air-Conditioning Control System]

Figure 4:
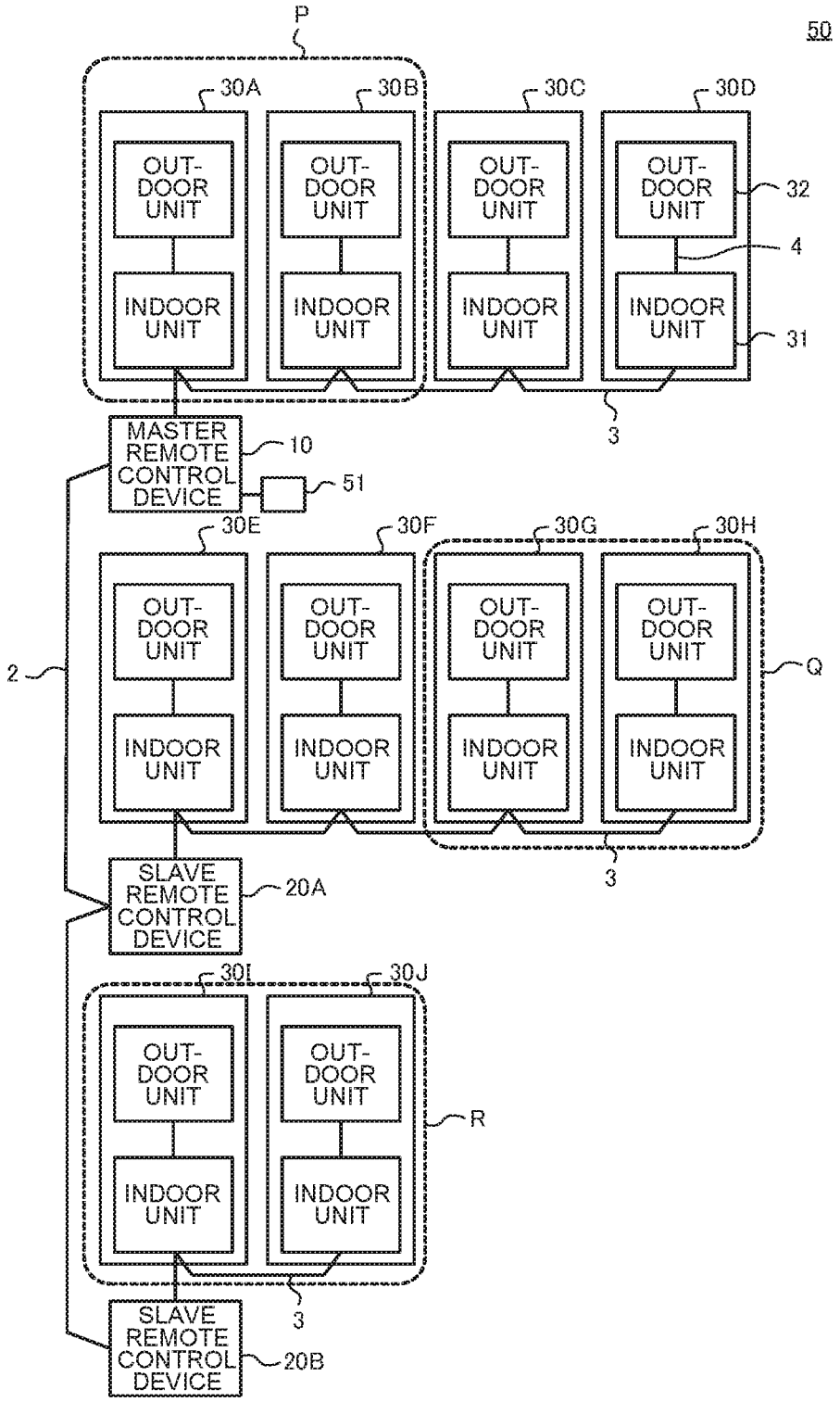
FIG. 4 is a block diagram showing an exemplary configuration of an air-conditioning control system according to Embodiment 2.

FIG. 4 is a block diagram showing an exemplary configuration of an air-conditioning control system 50 according to Embodiment 2.

As shown in FIG. 4, the air-conditioning control system 50 includes a temperature sensor 51 in addition to the configuration of the air-conditioning control system 1 according to Embodiment 1 described above. The temperature sensor 51 is provided near the position of the master remote control device 10 or the indoor unit 31 of the air-conditioning apparatus 30. This example will be described on the assumption that the temperature sensor 51 is provided near the master remote control device 10.

The temperature sensor 51 detects a temperature of a space in which the temperature sensor 51 is installed, and supplies temperature information indicating a detection result to the master remote control device 10.

The master remote control device 10 calculates a temperature difference between the temperature of the space indicated by the temperature information supplied from the temperature sensor 51 and a set temperature set on the master remote control device 10. Then, based on the calculated temperature difference, the master remote control device 10 calculates the number of air-conditioning apparatuses 30 to be operated and operating capacities of the air-conditioning apparatuses 30 to maximize the COP of the entire system. Based on calculation results, the master remote control device 10 controls associated air-conditioning apparatus 30 in the system to cause them to operate at the calculated operating capacities.

[Configuration of Master Remote Control Device]

In the control unit 15 as shown in FIG. 3, the master remote control device 10 calculates the number of air-conditioning apparatuses 30 to be operated and operating capacities of the air-conditioning apparatuses 30 to maximize the COP of the entire system described above.

The control unit 15 calculates the temperature difference based on the set temperature and the temperature information from the temperature sensor 51. Based on the calculated temperature difference and on information stored in the storage unit 13, which indicates the number of slave remote control devices 20 and the number of indoor units 31 in the system, the control unit 15 calculates the number and operating capacities of the air-conditioning apparatuses 30 that maximize the COP. Then, based on calculation results, the control unit 15 determines air-conditioning apparatuses 30 to be operated.

The following description is given by referring to by way of example referring to the case where an air-conditioning control system 50 is made up of 32 indoor units 31 installed in the same space and provided with similar capacities.

In the case where the master remote control device 10 calculates that the COP will be maximized when two indoor units 31 operate at 80% capacity, it causes two predetermined indoor units 31 to operate at 80% capacity.

At this time, preferably, the two predetermined indoor units 31 should not be operated constantly; i.e., it is preferable that of the all the indoor units 31, indoor units 31 to be operated be randomly selected and applied, each time a predetermined time period elapses; that is, the indoor units 31 to be operated be changed each time the predetermined time period elapses. This is intended to uniformize the temperature in the same space.

Specifically, for example, first, the master remote control device 10 controls predetermined air-conditioning apparatus 30A and 30B surrounded by a dotted line P to cause them to operate at 80% capacity. Next, after the elapse of a predetermined time period, the master remote control device 10 controls using the slave remote control device 20A the air-conditioning apparatus 30G and 30H surrounded by a dotted line Q to cause them to operate at similar capacities. After the predetermined time period further elapses, the master remote control device 10 controls using the slave remote control device 20B the air-conditioning apparatus 301 and 30J surrounded by a dotted line R to cause them to operate at similar capacities.

In such a manner, in Embodiment 2, among all the air-conditioning apparatus 30 connected to the master remote control device 10 or slave remote control devices 20, the air-conditioning apparatuses 30 to be operated are changed each time the predetermined time period elapses. Thus, a larger number of air-conditioning apparatuses 30 can be subjected to control for maximizing COP than in conventional systems.

Specifically, for example, the conventional systems can perform control for maximizing COP on only four air-conditioning apparatus by a single remote control device, whereas the air-conditioning control system 50 according to Embodiment 2 can perform the above control on five or more air-conditioning apparatuses 30.

It should be noted that that although the control unit 15 determines the number of air-conditioning apparatuses 30 to be operated and operating capacities of the air-conditioning apparatus 30 to maximize the COP of the entire system, its operation is not limited to this example.

For example, it may be set such that the control unit 15 sets in advance the number of air-conditioning apparatuses 30 to be operated while keeping the operating capacity at or above a fixed value, and performs control to maximize the COP using the set number of air-conditioning apparatus 30. As a result, it is possible to maintain comfortability in the space.

Embodiment 3

Next, an air-conditioning control system according to Embodiment 3 will be described.

The air-conditioning control system according to Embodiment 3 sets air-conditioning apparatuses that are to periodically repeatedly operate and stop, and controls the set air-conditioning apparatuses to operate alternately; that is, it controls the set air-conditioning apparatuses to perform a so-called rotation operation.

It should be noted that that in the following description, components similar to those of Embodiments 1 and 2 are denoted by the same reference numerals as the corresponding components of Embodiments 1 and 2, and theirs detailed descriptions are omitted.

[Configuration of Air-Conditioning Control System]

Figure 5:
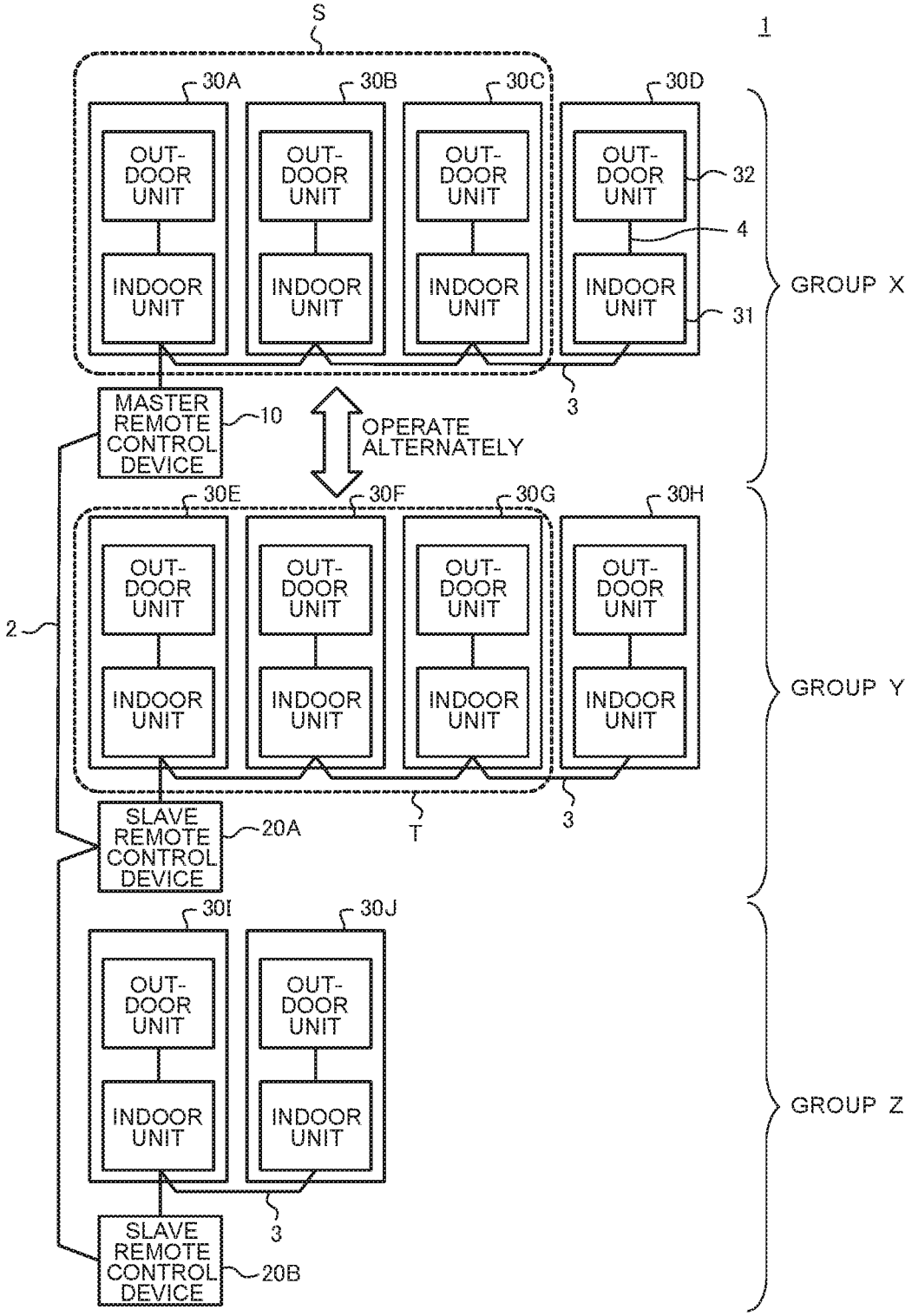
FIG. 5 is a block diagram showing an exemplary configuration of an air-conditioning control system according to Embodiment 3.

FIG. 5 is a block diagram showing an exemplary configuration of an air-conditioning control system 1 according to Embodiment 3.

A configuration of the air-conditioning control system 1 according to Embodiment 3 is similar to the air-conditioning control system 1 according to Embodiment 1 described above.

In the example as shown in FIG. 5, the air-conditioning apparatuses 30A to 30C surrounded by a dotted line S and the air-conditioning apparatus 30E to 30G surrounded by a dotted line T are set in advance to periodically repeatedly operate and stop.

The air-conditioning apparatuses 30 that are to periodically repeatedly operate and stop are set, for example, by the user with the master remote control device 10.

With respect to each of the groups, the user selects a predetermined number of air-conditioning apparatuses 30 from the air-conditioning apparatuses 30 belonging to the group controlled by the master remote control device 10 and the air-conditioning apparatuses 30 belonging to the groups controlled by the slave remote control devices 20A and 20B. Once air-conditioning apparatuses 30 are selected in this way, the master remote control device 10 sets and controls the selected air-conditioning apparatus 30 to cause them operate in turn, using, as a relay device, the slave remote control device 20 associated with the group to which the selected air-conditioning apparatuses 30 belong.

The following description is given by referring to by way of the case where as shown in FIG. 5, the three air-conditioning apparatuses 30A to 30C belonging to group X and surrounded by the dotted line S and the three air-conditioning apparatuses 30E to 30G belonging to group Y and surrounded by a dotted line T are selected.

In this case, the master remote control device 10 performs control such that first, the air-conditioning apparatuses 30A to 30C belonging to group X operate. Next, after the air-conditioning apparatuses 30A to 30C stop their operation, the master remote control device 10 performs control with the slave remote control device 20A such that the air-conditioning apparatuses 30E to 30G belonging to group Y operate. Then, the master remote control device 10 causes the air-conditioning apparatuses 30A to 30C and the air-conditioning apparatuses 30E to 30G to repeat this operation in sequence.

In such a manner, in Embodiment 3, among all the air-conditioning apparatus 30 connected to the master remote control device 10 and slave remote control devices 20, a predetermined number of air-conditioning apparatuses 30 selected on a group by group basis are controlled to be operated in sequence. Thus, the air-conditioning apparatuses 30 controllable by the master remote control device 10 and the slave remote control devices 20 can be operated in rotation, whereas conventionally, only the air-conditioning apparatuses controllable by a single remote control device can be operated in rotation.

It should be noted that although with respect to the example described above, it is described that two groups are operated in rotation, the operation is not limited to such an operation; that is, three or more groups may be operated in rotation.

Furthermore, the master remote control device 10 may set an operation schedule for each slave remote control device 20 with respect to operation of air-conditioning apparatuses 30. Thereby, according to the set operation schedule, the slave remote control devices 20 can operate autonomously, and cause associated air-conditioning apparatuses 30 to operate.

Embodiment 4

Next, an air-conditioning control system according to Embodiment 4 will be described.

Generally, there is a case where when an air-conditioning apparatus continues heating operation, frost adheres to the outdoor unit, and defrosting operation is thus performed to remove adhering frost. Also, where air-conditioning apparatuses having equivalent operating capacities are installed under equivalent environments, and perform heating operation, there is a possibility that the air-conditioning apparatus will start defrosting operation simultaneously.

If the air-conditioning apparatus simultaneously perform defrosting operation, the temperature in space where the indoor units are installed lowers, and comfortability remarkably lowers. Therefore, in a conventional air-conditioning system capable of controlling operation of air-conditioning apparatuses, the operation of the air-conditioning apparatuses is controlled to prevent the air-conditioning apparatuses from simultaneously starting defrosting operation.

However, in an air-conditioning control system including a plurality of groups controlled by different remote control devices, it is hard to perform control such that the groups do not start defrosting operation simultaneously.

In view of the above, in the air-conditioning control system according to Embodiment 4, even where it includes a plurality of groups, during heating operation, it controls the operation of the air-conditioning apparatuses in the system such that defrosting operations of the air-conditioning apparatuses do not overlap each other.

It should be noted that in the following description, components similar to those of Embodiments 1 to 3 are denoted by the same reference numerals as the corresponding components of Embodiments 1 to 3, and their detailed descriptions are omitted.

In Embodiment 4, the control unit 15 of the master remote control device 10 determines by estimation defrost start times at which respective air-conditioning apparatuses 30 will start defrosting operation and defrost durations for which the defrosting operations will continue. Then, the control unit 15 controls heating capacities of the air-conditioning apparatuses 30 such that the defrost start times and defrost durations thereof do not coincide with each other.

The control unit 15 of the master remote control device 10 calculates defrost start times and defrost durations based on suction temperatures in the indoor units 31 of the air-conditioning apparatuses 30.

Based on the calculated defrost start times of the air-conditioning apparatuses 30, the control unit 15 determines whether or not air-conditioning apparatuses 30 are present which start defrosting operation simultaneously.

Also, based on the calculated defrost durations, the control unit 15 determines whether or not air-conditioning apparatuses 30 are present whose defrost durations coincide with each other.

If the results of the above determinations indicate that air-conditioning apparatuses 30 are present which coincide with each other in defrost start time and defrost duration, the control unit 15 adjusts the heating capacities of those air-conditioning apparatuses 30. Then, the control unit 15 causes the air-conditioning apparatuses 30 to carry out defrosting operation in rotation to minimize a period of defrosting operation.

In such a manner, in Embodiment 4, the control unit 15 determines by estimation the defrost start times and defrost durations of all the air-conditioning apparatuses 30 in the system, and adjusts the heating capacities of the air-conditioning apparatuses 30 in response to the result of the determination made by estimation. As a result, it is possible to restrict simultaneously starting of defrosting operations by the air-conditioning apparatuses 30, and minimize the period of defrosting operation. It is therefore possible to maintain comfortability in the space.

Also, even in the case where groups controlled by different remote control devices are provided in the system, the operations of the air-conditioning apparatuses 30 can be controlled such that all the air-conditioning apparatuses 30 will not start defrosting operations simultaneously.

Although Embodiments 1 to 4 of the present invention has been described above, the present invention is not limited to Embodiments 1 to 4 as described above, and various alterations and applications are possible without departing from the spirit of the present invention.

For example, although it is described above that with respect to the second communication system, i.e., the system of communication between remote control devices such as the slave remote control devices 20 and the indoor units 31 of the air-conditioning apparatuses 30, Embodiments 1 to 4 are the same as each other, this is not restrictive, and, for example, those Embodiments may use different communication systems.

In that case, for example, the remote control devices are provided with a gateway function or bridge function. The remote control devices convert the format of communication data received by the first communication system into a data format compatible with air-conditioning apparatuses 30 to be controlled. Thereby, it is possible to incorporate an air-conditioning system configured as a different system into the air-conditioning control system according to the present invention, and cause it to cooperate with the air-conditioning control system using the remote control devices.

REFERENCE SIGNS LIST

1, 50 air-conditioning control system 2, 3, 4 connecting line 10 master remote controller device 11 first communication unit 12 second communication unit 13 storage unit 14 operating unit 15 control unit 20, 20A, 20B slave remote controller device 30, 30A-30J air-conditioning apparatus 31 indoor unit 32 outdoor unit 40 portable terminal 41 temperature and humidity sensor 51 temperature sensor.

The invention claimed is:

1. An air-conditioning control system comprising:

a plurality of air-conditioning apparatuses each including an indoor unit and an outdoor unit;

a master remote control device associated with at least one of the plurality of air-conditioning apparatuses, and configured to control operation of the associated at least one of the plurality of air-conditioning apparatuses;

one or more slave remote control devices connected with the master remote control device using a first communication system, associated with a remaining one or ones of the plurality of air-conditioning apparatuses, and configured to control operation of the associated remaining one or ones of the plurality of air-conditioning apparatus; and a temperature sensor configured to detect a temperature of a location where at least one of the master remote control device and the indoor units is installed, wherein the indoor unit of each of the plurality of air-conditioning apparatuses is connected with an associated one of the master remote control device and the one or more slave remote control devices using a second communication system different from the first communication system, and wherein the master remote control device includes memory configured to receive, from the one or more slave remote control devices connected with the master remote control device using the first communication system, information regarding the remaining one or ones of the plurality of air-conditioning apparatuses which are associated with the one or more slave remote control devices, and store the information, and the master remote control device is configured to control based on the information stored in the memory, the operation of the remaining one or ones of the air-conditioning apparatuses with the one or more slave remote control devices, wherein the master remote control device is configured to:

receive information regarding the number of slave remote control devices and the number of indoor units, store information regarding the number of slave remote control devices and the number of indoor units in the memory of the master remote control device; and determine an air-conditioning apparatus to be operated out of the plurality of air-conditioning apparatuses based on user operation; and the master remote control device is configured to determine the air-conditioning apparatus to be operated by:

calculating temperature differences between temperatures set for the plurality of air-conditioning apparatuses and the temperature detected by the temperature sensor, calculating the number and operating capacities of air-conditioning apparatuses that maximize a coefficient of performance based on the calculated temperature differences and the information regarding the number of slave remote control devices and the number of indoor units, and determining the air-conditioning apparatus to be operated to maximize the coefficient of performance based on a result of the calculation.

2. The air-conditioning control system of claim 1, wherein the controller is configured to perform a control to change the air-conditioning apparatus to be operated, each time a predetermined time period elapses.

3. The air-conditioning control system of claim 1, wherein the master remote control device is configured to:

select an air-conditioning apparatus to be caused to periodically repeatedly operate and stop from the at least one of the air-conditioning apparatuses which is associated with the master remote control device, and also an air-conditioning apparatus to be caused to periodically repeatedly operate and stop from the remaining one or ones of the air-conditioning apparatuses which are associated with the one or more slave remote control devices; and control operation of the selected air-conditioning apparatuses such that the selected air-conditioning apparatuses operate in turn.

4. The air-conditioning control system of claim 1, wherein the master remote control device is configured to:

calculate a start time and a duration of a defrosting operation in each of the air-conditioning apparatuses based on a suction temperature of each of the indoor units; and control the operation of each of the air-conditioning apparatuses, based on the calculated start time and duration, such that the defrosting operations in the air-conditioning apparatuses do not overlap with each other.

5. The air-conditioning control system of claim 1, wherein the first communication system is a wireless communication system.

6. The air-conditioning control system of claim 1, wherein:

at least one of the slave remote control devices has at least one of a gateway function and a bridge function; and the at least one of the slave remote control devices which has at least one of the gateway function and the bridge function is connected with the indoor units of the air-conditioning apparatuses using a communication system different from the first communication system and the second communication system.

7. A remote control device which is associated with one or more air-conditioning apparatuses each including an indoor unit and an outdoor unit, and controls operation of the air-conditioning apparatuses, wherein the remote control device is connected with an other remote control device associated with an other air-conditioning apparatus, using a first communication system;

wherein the remote control device is connected with the indoor unit of each of the associated one or more air-conditioning apparatuses using a second communication system different from the first communication system;

wherein the remote control device includes memory configured to receive, from the other remote control device connected with the remote control device using the first communication system, information regarding the other air-conditioning apparatus associated with the other remote control device, and store the information, and wherein the remote control device controls based on the information stored in the memory, operation of the other air-conditioning apparatus with the other remote control device, wherein the remote control device is configured to:

receive information regarding the number of other remote control devices and the number of indoor units, store information regarding the number of other remote control devices and the number of indoor units in the memory of the remote control device; and determine an air-conditioning apparatus to be operated out of the air-conditioning apparatuses based on user operation; and the remote control device is configured to determine the air-conditioning apparatus to be operated by:

calculating temperature differences between temperatures set for the air-conditioning apparatuses and the temperature detected by a temperature sensor configured to detect a temperature of a location where at least one of the remote control device and the indoor units is installed, calculating the number and operating capacities of air-conditioning apparatuses that maximize a coefficient of performance based on the calculated temperature differences and the information regarding the number of other remote control devices and the number of indoor units, and determining the air-conditioning apparatus to be operated to maximize the coefficient of performance based on a result of the calculation.

* * * * *